US009082356B2

(12) United States Patent
Oh et al.

(10) Patent No.: US 9,082,356 B2
(45) Date of Patent: Jul. 14, 2015

(54) LIQUID CRYSTAL DISPLAY APPARATUS AND METHOD OF DRIVING THE SAME

(75) Inventors: Hyun-Uk Oh, Yongin (KR); Young-Kwang Kim, Yongin (KR)

(73) Assignee: SAMSUNG DISPLAY CO., LTD., Yongin, Gyeonggi-Do (KR)

( * ) Notice: Subject to any disclaimer, the term of this patent is extended or adjusted under 35 U.S.C. 154(b) by 788 days.

(21) Appl. No.: 13/137,909

(22) Filed: Sep. 21, 2011

(65) Prior Publication Data

US 2012/0133630 A1 May 31, 2012

(30) Foreign Application Priority Data

Nov. 25, 2010 (KR) ..... 10-2010-0118082

(51) Int. Cl.
*G09G 3/36* (2006.01)

(52) U.S. Cl.
CPC ..... *G09G 3/3614* (2013.01); *G09G 3/3655* (2013.01); *G09G 2330/021* (2013.01)

(58) Field of Classification Search
CPC ..... G09G 2330/021; G09G 3/3614; G09G 3/3655
USPC ..... 345/211, 209, 87, 94, 98, 92, 690
See application file for complete search history.

(56) References Cited

U.S. PATENT DOCUMENTS

| | | | | |
|---|---|---|---|---|
| 6,492,970 | B1 * | 12/2002 | Furuhashi et al. | 345/94 |
| 2006/0146006 | A1 | 7/2006 | Lee et al. | |
| 2008/0068321 | A1 * | 3/2008 | Kim et al. | 345/90 |
| 2009/0128722 | A1 | 5/2009 | Kim et al. | |
| 2011/0007060 | A1 * | 1/2011 | Jarupoonphol et al. | 345/212 |
| 2011/0102404 | A1 * | 5/2011 | Hou | 345/211 |
| 2011/0242145 | A1 * | 10/2011 | Nishimura et al. | 345/690 |
| 2012/0038614 | A1 * | 2/2012 | Mizumaki | 345/211 |

FOREIGN PATENT DOCUMENTS

| | | | |
|---|---|---|---|
| KR | 10 2001-00977 | A | 11/2001 |
| KR | 10 2001-01128 | A | 12/2001 |
| KR | 10 2006-00799 | A | 7/2006 |
| KR | 10 2008-00610 | A | 7/2008 |
| KR | 10 2009-00508 | A | 5/2009 |

* cited by examiner

*Primary Examiner* — Quan-Zhen Wang
*Assistant Examiner* — Tony Davis
(74) *Attorney, Agent, or Firm* — Lee & Morse, P.C.

(57) ABSTRACT

Present embodiments may include a liquid crystal display apparatus, using a line reversal method, wherein at least one pulse is inserted between charging periods, and a method of driving the liquid crystal display apparatus. According to present embodiments, in a liquid crystal display apparatus employing a polarity reversal method, audible noise may be removed without increasing a frame frequency and reducing a charging time of a storage capacitor.

20 Claims, 6 Drawing Sheets

LIQUID CRYSTAL DISPLAY APPARATUS AND METHOD OF DRIVING THE SAME

BACKGROUND

1. Field

Present embodiments relate to a liquid crystal display apparatus and a method of driving the same.

2. Description of the Related Art

Liquid crystal display apparatuses display images corresponding to input data by converting the input data into a data voltage with a data driving unit. Liquid crystal display apparatuses control a scanning operation of each pixel with a gate driving unit to adjust the brightness of each pixel. A liquid crystal display apparatus changes the orientation of a liquid crystal layer to adjust the brightness of each pixel. Each pixel of the liquid crystal display apparatus includes a storage capacitor, for storing a data signal level, and a liquid crystal layer, in which its orientation changes according to the data signal level. The liquid crystal layer also adjusts brightness. A common voltage may be applied to the liquid crystal layer and the storage capacitor.

SUMMARY

Present embodiments may provide a liquid crystal display apparatus that employs a polarity reversal method.

According to an aspect of present embodiments, there may be provided a method of driving a liquid crystal display apparatus, including a line reversal method and a plurality of pixels, the method may include: a first charging period in which a data signal and a common voltage are applied to a plurality of pixels of a first line so that the plurality of pixels of the first line selected represent first polarities; a first intermediate period in which pixel electrodes of the plurality of pixels and data lines for delivering the data signal are electrically blocked, wherein the common voltage includes at least one pulse; a second charging period in which the data signal and the common voltage are applied to a plurality of pixels of a second line so that the plurality of pixels of a second line selected represent second polarities opposite to first polarities; and a second intermediate period in which the pixel electrodes of the plurality of pixels and the data lines are electrically blocked, wherein the common voltage includes at least one pulse.

The first intermediate period and the second intermediate period may have at least one rising pulse.

A voltage level of the common voltage may be higher in the first charging period than in the second charging period, and the first intermediate period includes: a first period in which the common voltage has a voltage level between voltage levels of the first and second charging periods; a second period in which the common voltage has a voltage level that is higher than that in the first period and that is equal to or lower than that of the first charging period; and a third period in which the common voltage has a voltage level between the voltage levels of the first and second charging periods.

The voltage level of the common voltage may be higher in the first charging period than in the second charging period, and the second intermediate period includes: a fourth period in which the common voltage has a voltage level lower than that of the second charging period; a fifth period in which the common voltage has a voltage level that is higher than that of the fourth period and that is equal to or lower than that of the first charging period; and a sixth period in which the common voltage has a voltage level that is lower than those of the fifth period and the first charging period.

The first intermediate period may have at least one falling pulse, and the second intermediate period has at least one rising pulse.

The voltage level of the common voltage may be higher in the first charging period than in the second charging period, and the first intermediate period includes: a first period in which the common voltage has a voltage level between the voltage levels of the first and second charging periods; a second period in which the common voltage has a voltage level lower than that of the first period; and a third period in which the common voltage has a voltage higher than that of the second period.

The voltage level of the common voltage may be higher in the first charging period than in the second charging period, and the second intermediate period includes: a fourth period in which the common voltage has a voltage level lower than that of the second charging period; a fifth period in which the common voltage has a voltage level that is higher than that of the fourth period and that is equal to or lower than that of the first charging period; and a sixth period in which the common voltage has a voltage level that is lower than those of the fifth period and the first charging period.

The common voltage may less than 20,000 periods within one second.

The common voltage may be applied through a common voltage layer, electrically connected to the plurality of pixels in common.

According to another aspect of present embodiments, there may be provided a liquid crystal display apparatus including: a plurality of pixels; a common voltage electrode that is connected to the plurality of pixels in common; a gate driving unit for outputting a gate signal via gate lines to each of the pixels; a data driving unit for generating a data signal corresponding to an input image and outputting the data signal to each of the plurality of pixels via data lines; and a common voltage driving unit for generating a common voltage and applying the common voltage to the plurality of pixels through the common voltage electrode, wherein the driven common voltage includes: a first charging period in which the data signal and the common voltage are applied to a plurality of pixels of a first line so that the plurality of pixels of the first line selected by the gate signal represent first polarities; a first intermediate period in which data lines for delivering the data signal and pixel electrodes of the plurality of pixels are electrically blocked, wherein the common voltage includes at least one pulse; a second charging period in which the data signal and the common voltage are applied to the plurality of pixels of a second line so that the plurality of pixels of the second line selected by the gate signal represent second polarities, opposite to the first polarities; and a second intermediate period in which the pixel electrodes of the plurality of pixels and the data lines are electrically blocked, wherein the common voltage includes at least one pulse.

The first intermediate period and the second intermediate period may have at least one rising pulse.

A voltage level of the common voltage may be higher in the first charging period than in the second charging period, and the first intermediate period includes: a first period in which the common voltage has a voltage level between voltage levels of the first and second charging periods; a second period in which the common voltage has a voltage level that is higher than that in the first period and that is equal to or lower than that of the first charging period; and a third period in which the common voltage has a voltage level between the voltage levels of the first and second charging periods.

The voltage level of the common voltage may be higher in the first charging period than in the second charging period, and the second intermediate period includes: a fourth period in which the common voltage has a voltage level lower than that of the second charging period; a fifth period in which the common voltage has a voltage level that is higher than that of the fourth period and that is equal to or lower than that of the first charging period; and a sixth period in which the common voltage has a voltage level that is lower than those of the fifth period and the first charging period.

The first intermediate period may have at least one falling pulse, and the second intermediate period has at least one rising pulse.

The voltage level of the common voltage may be higher in the first charging period than in the second charging period, and the first intermediate period includes: a first period in which the common voltage has a voltage level between the voltage levels of the first and second charging periods; a second period in which the common voltage has a voltage level lower than that of the first period; and a third period in which the common voltage has a voltage higher than that of the second period.

The voltage level of the common voltage may be higher in the first charging period than in the second charging period, and the second intermediate period includes: a fourth period in which the common voltage has a voltage level lower than that of the second charging period; a fifth period in which the common voltage has a voltage level that is higher than that of the fourth period and that is equal to or lower than that of the first charging period; and a sixth period in which the common voltage has a voltage level that is lower than those of the fifth period and the first charging period.

The common voltage may have less than 20,000 periods within one second.

The common voltage electrode may be formed to have a plate structure connected to the plurality of pixels in common.

Each pixel of the plurality of pixels may include: a first switching transistor including a gate electrode connected to the gate line, a first electrode connected to the data line, and a second electrode connected to a first node; a liquid crystal layer interposed between a pixel electrode, which is connected to the first node, and the common voltage electrode; and a storage capacitor connected between the first node and the common voltage electrode.

BRIEF DESCRIPTION OF THE DRAWINGS

The above and other features and advantages of the inventive concept will become more apparent by describing in detail exemplary embodiments thereof with reference to the attached drawings in which.

DETAILED DESCRIPTION

Korean Patent Application No. 10-2010-0118082, filed on Nov. 25, 2010, in the Korean Intellectual Property Office, and entitled "Liquid Crystal Display Apparatus and Method of Driving the Same," is incorporated by reference herein in its entirety.

The inventive concept will now be described more fully hereinafter with reference to the accompanying drawings, in which exemplary embodiments of the inventive concept are illustrated. The inventive concept, may, however, be embodied in different forms and should not be construed as limited to the embodiments set forth herein. Rather, these embodiments are provided so that this disclosure will be thorough and complete, and will fully convey the scope of the inventive concept to those skilled in the art.

Figure 1:
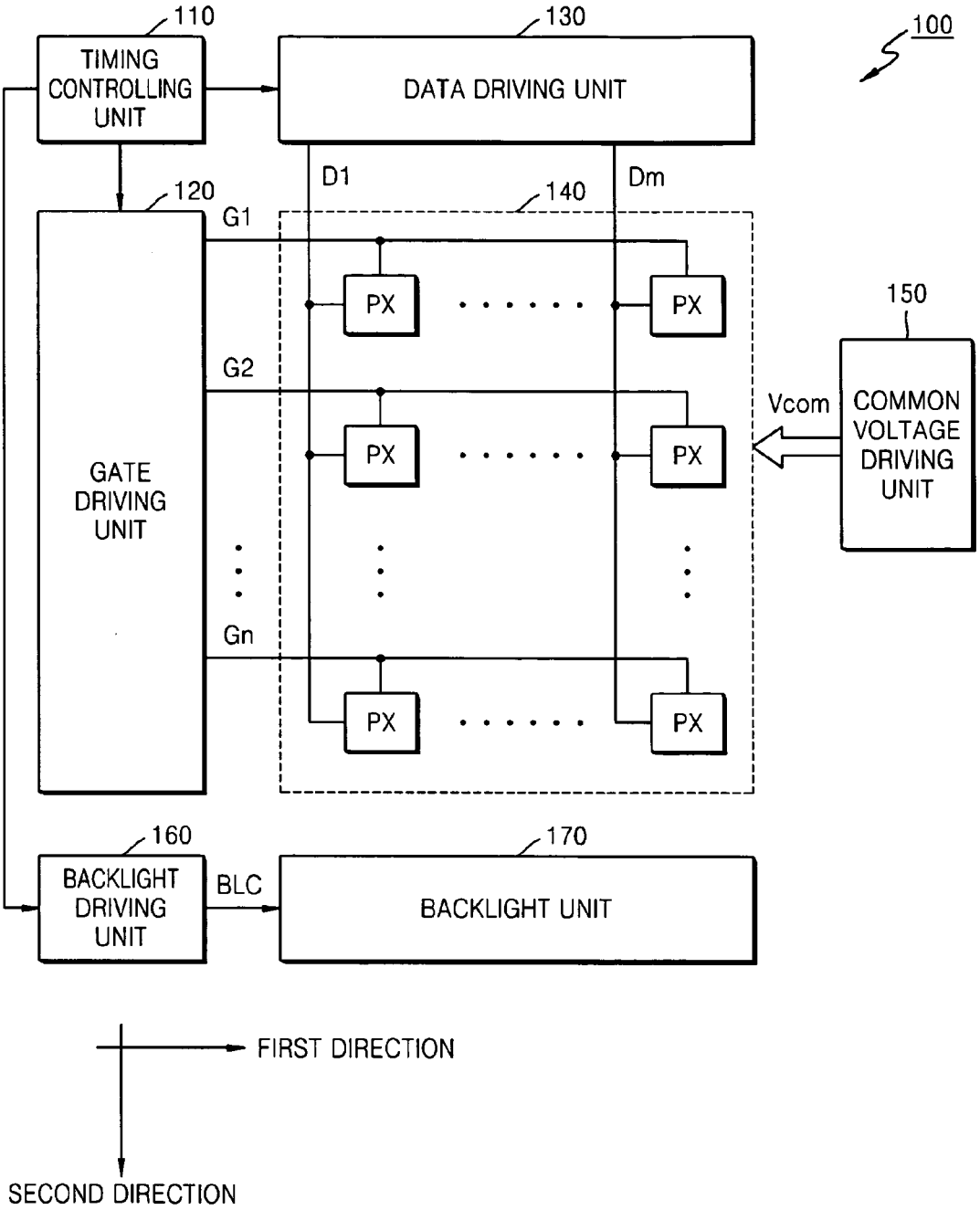
FIG. 1 is a schematic diagram illustrating a liquid crystal display apparatus according to an embodiment.

FIG. 1 is a schematic diagram illustrating a liquid crystal display apparatus 100 according to an embodiment.

The liquid crystal display apparatus 100, according to an embodiment, includes a timing controlling unit 110, a gate driving unit 120, a data driving unit 130, a pixel unit 140, a common voltage driving unit 150, a backlight driving unit 160, and a backlight unit 170.

The timing controlling unit 110 receives an input image signal, a data enable signal, a vertical synchronization signal, a horizontal synchronization signal, a clock signal, etc. from an external graphic controller (not shown). The timing controller 110 generates an image data signal, a data driving control signal, a gate driving control signal, etc.

The timing controlling unit 110 receives an input control signal. For example, an input signal may be the horizontal synchronization signal, the clock signal, the data enable signal, etc. The timing controller 110 outputs the data driving control signal. The data driving control signal controls operations of the data driving unit 130. The data driving unit 130 may include a source shift clock, a source start pulse, a polarity control signal, a source output enable signal, etc. The timing controlling unit 110 receives a vertical synchronization signal, a clock signal, etc. and outputs a gate driving control signal. The gate driving control signal controls operations of the gate driving unit 120. The gate driving unit 120 may include a gate start pulse, a gate output enable signal, etc.

In correspondence to the gate driving control signal applied from the timing controlling unit 110, the gate driving unit 120 generates a gate signal having a sequential scan pulse according to an order of rows. The gate driving unit 120 applies the gate signal to gate lines G1 through Gn. The gate driving unit 120 determines a voltage level of each scan pulse according to a gate high voltage and a gate low voltage. The gate high voltage and the gate low voltage are generated by a direct current DC/DC converter (not shown). The voltage level of the scan pulse may vary according to the type of switching device included in pixel PX. When the switching device is an n-type transistor, the scan pulse has a gate high voltage during activation. When the switching device is a p-type transistor, the scan pulse has a gate low voltage during activation.

The data driving unit 130 applies a data signal to data lines D1 through Dm in correspondence to the image data signal and the data driving control signal, applied from the timing controlling unit 110. The data driving unit 130 samples and latches the image data signal applied from the timing controlling unit 110. The data driving unit 130 converts the image data signal into an analog data signal that may express gradation in a plurality of pixels PX of the pixel unit 140. Gradation in a plurality of pixels PX of the pixel unit 140 occurs by using a gamma standard voltage applied from a gamma standard voltage circuit (not shown).

The pixel unit 140 includes the plurality of pixels PX disposed at cross-points, between the data lines D1 through Dm and the gate lines G1 through Gn. Each of the pixels PX is connected to at least one data line Di and at least one gate line Gj. A common voltage Vcom is applied to each pixel PX via a common voltage electrode 408 (see FIG. 4). The gate lines G1 through Gn extends in a first direction, and are aligned in parallel. The data lines D1 through Dm extend in a second direction, and are aligned in parallel. Alternatively, the gate lines G1 through Gn may extend in the second direction. The data lines D1 through Dm may extend in the first direction. Hereinafter, a structure of the pixel PX according to an embodiment will be described with reference to FIG. 2.

Figure 2:
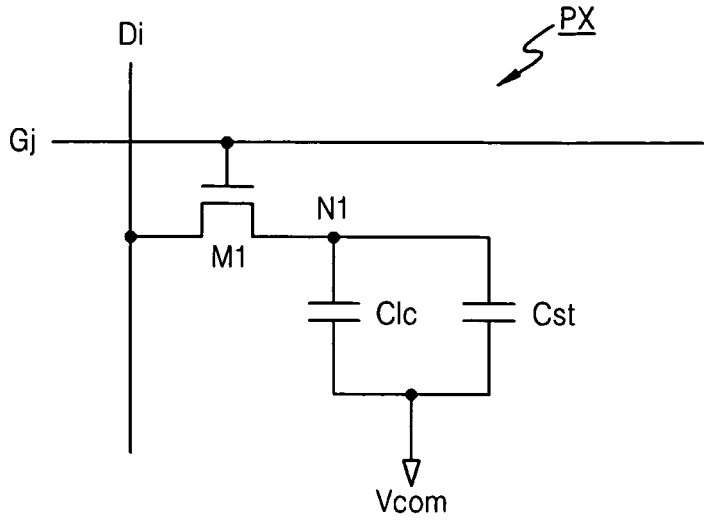
FIG. 2 is a diagram illustrating a structure of a pixel, according to an embodiment.

FIG. 2 is a circuit diagram illustrating the structure of the pixel PX, according to an embodiment.

The pixel PX includes a switching transistor M1, a liquid crystal layer Clc, and a storage capacitor Cst. The pixel PX includes upper and lower substrates of a liquid crystal display (LCD) panel (i.e., includes a common voltage electrode and a pixel electrode formed on the upper and lower substrates). The liquid crystal layer Clc is interposed between the upper and lower substrates. The switching transistor M1 includes a gate electrode connected to the gate line Gj, a first electrode connected to the data line Di, and a second electrode connected to a first node N1. The switching transistor M1 may be configured as a thin film transistor (TFT). The first node N1 is a node that is electrically equivalent to the pixel electrode 406 (see FIG. 4). The liquid crystal layer Clc is disposed between the first node N1 and a common voltage electrode 408 (see FIG. 4). The common voltage electrode 408 transmits the common voltage Vcom. The liquid crystal layer Clc is electrically equivalent to the pixel electrode 406, the common voltage electrode 408, and liquid crystal molecules LC (see FIG. 4) interposed between the pixel electrode 406 and the common voltage electrode 408. The storage capacitor Cst is connected between the first node N1 and the common voltage electrode 408. The common voltage electrode 408 transmits the common voltage Vcom.

When a scan pulse is input to the gate line Gj, the switching transistor M1 is turned on. Thus, a data signal input via the data line Di is applied to the first node N1. A voltage level of the data signal is stored in the storage capacitor Cst. Orientation of the liquid crystal molecules LC of the liquid crystal layer Clc is changed by the voltage at the first node N1. Thus, light transmittance is changed of the liquid crystal layer Clc.

Figure 3:
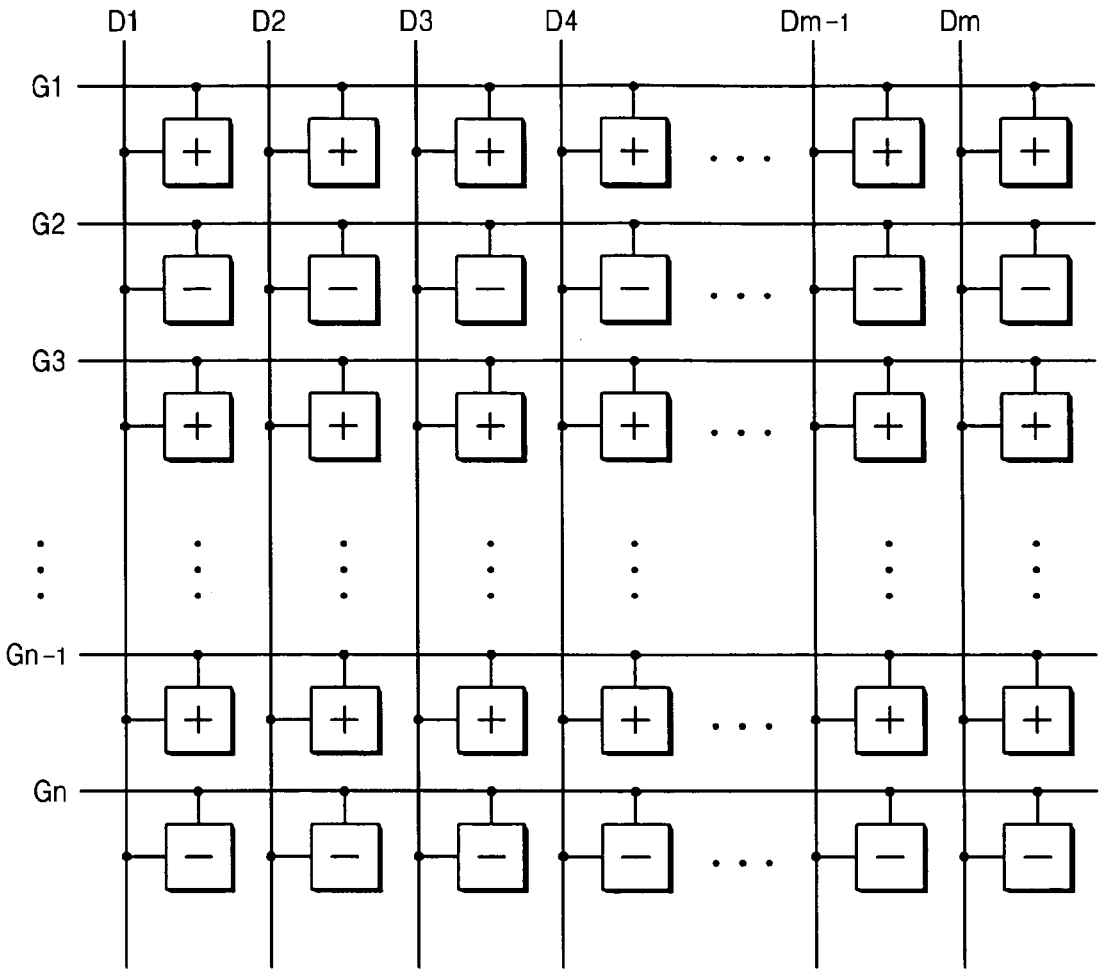
FIG. 3 is a diagram for describing a line reversal method according to an embodiment.
Figure 4:
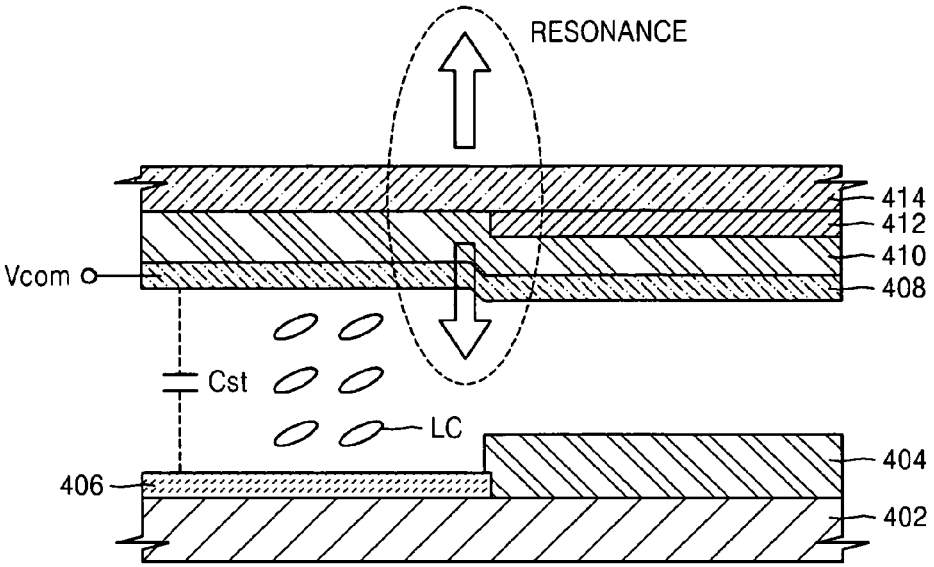
FIG. 4 is a cross-sectional view illustrating a structure of a pixel, according to an embodiment.

The common voltage driving unit 150 (see FIG. 1) generates a common voltage Vcom and applies the common voltage Vcom to the pixel unit 140 via the common voltage electrode 408 (see FIG. 4). The common voltage driving unit 150 generates the common voltage Vcom so as to reverse a polarity of each pixel PX for each frame. The common voltage driving unit 150 generates the common voltage Vcom in order to drive the plurality of pixels PX by using a line reversal method. The common voltage driving unit 150 outputs the common voltage Vcom to each of the pixels PX via the common voltage electrode 408. Hereinafter, the line reversal method is described with reference to FIG. 3.

According to an embodiment, FIG. 3 is a diagram for explaining the line reversal method. In FIG. 3, the liquid crystal display apparatus 100 may be driven by using the line reversal method. The line reversal method is where a polarity is reversed, row by row. FIG. 3 illustrates polarities of a voltage applied to the liquid crystal layer Clc during one frame. The voltage having a positive polarity is changed to the voltage having a negative polarity to be applied during the next frame. The voltage having a negative polarity is also changed to the voltage having a positive polarity to be applied during the next frame. When the common voltage Vcom having a low level is applied, in the positive polarity, a data signal having a higher level than the common voltage Vcom is applied. Thus, the data signal is written in each pixel PX. When the common voltage Vcom having a high level is applied, in the negative polarity, a data signal having a lower level than the common voltage Vcom is applied. Thus, the data signal is applied to each pixel PX.

The backlight unit 170 (see FIG. 1) is disposed at a rear side of the pixel unit 140. The pixel unit 140 emits light according to a backlight driving signal BLC, applied from the backlight driving unit 160. Thus, the light is radiated onto the pixels PX of the pixel unit 140. The backlight driving unit 160 generates the backlight driving signal BLC under the control of the timing controlling unit 110. The timing controlling unit 110 outputs the backlight driving signal BLC to the backlight unit 170 to control the backlight unit 170 for light emission.

FIG. 4 is a cross-sectional view illustrating a structure of the pixel PX, according to an embodiment.

As illustrated in FIG. 4, the pixel PX according to an embodiment of the present invention includes a lower substrate 402, a TFT 404, the pixel electrode 406, the common voltage electrode 408, a color filter 410, a black matrix 412, and an upper substrate 414.

The lower substrate 402 and the upper substrate 414 may be a glass substrate, a low-temperature polysilicon (LTPS) substrate, etc. The TFT 404 functions as the switching transistor M1, wherein a first electrode may be electrically connected to the data line Di, a second electrode may be electrically connected to the pixel electrode 406, and a gate electrode may be electrically connected to the gate line Gj. The storage capacitor Cst may be formed between the pixel electrode 406 and the common voltage electrode 408. The liquid crystal layer Clc may be configured as the liquid crystal molecules LC, disposed between the pixel electrode 406 and the common voltage electrode 408. The color filter 410 may be formed to have optical characteristics corresponding to color components of the pixel PX. Thus, the color filter 410 may determine the color components of the pixel PX. The black matrix 412 may block a non-emitting area. The black matrix 412 may be formed on the upper substrate 404 in an area corresponding to the TFT 404. The color filter 410 may be interposed between the black matrix 412 and the common voltage electrode 408. The common voltage Vcom, generated by the common voltage driving unit 150 (see FIG. 1), is applied to the common voltage electrode 408.

Figure 5:
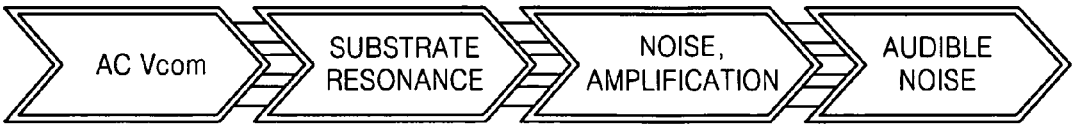
FIG. 5 is a diagram for describing a process in which audible noise is generated, according to an embodiment.

According to an embodiment, FIG. 5 is a diagram for explaining a process in which audible noise is generated. Hereinafter, the process in which the audible noise is generated is described with reference to FIGS. 4-5. When an alternating common voltage Vcom is applied to the common voltage electrode 408, mechanical vibration of the upper substrate 414 is generated by the alternating signal. The common voltage Vcom is delivered through the common voltage electrode 408 patterned on the entire upper substrate 414. Thus, resonance of a substrate, e.g., an upper substrate 414, occurs due to toggling of the alternating common voltage Vcom. The resonance of a substrate interferes with other noise of the liquid crystal display apparatus 100. The resonance may also be amplified due to driving of the liquid crystal display apparatus 100. Thus, the resonance may be an audible noise, within a human's frequency range.

In order to remove the audible noise from the liquid crystal display apparatus 100 using a line reversal method, a method of increasing a frame frequency of the common voltage Vcom may be used. However, this method complicates the design of an apparatus. In addition, limitations in increasing the frame frequency result in manufacturing difficulties of the liquid crystal display apparatus 100.

In order to remove the audible noise from the liquid crystal display apparatus 100 using the line reversal method, a method of increasing a frame frequency of the common voltage Vcom and increasing a porch period between charging periods for charging a data signal in the storage capacitor Cst may be considered. However, in this method, as the porch period is increased, a charging time of the storage capacitor Cst is reduced. Therefore, the data signal may not be completely charged in the storage capacitor Cst. Thus, a gray gradation has stains. In addition, reliability is decreased due to insufficient charging.

Figure 6:
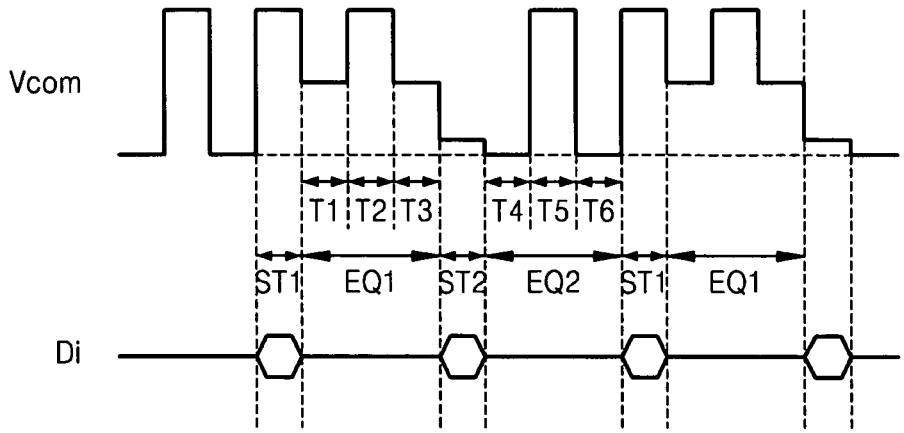
FIG. 6 is a timing diagram for describing a driving method of a common voltage, according to an embodiment.

FIG. 6 is a timing diagram for describing a driving method of the common voltage Vcom, according to an embodiment.

According to an embodiment, when the common voltage Vcom drives the liquid crystal display apparatus 100 in a line reversal method, a pulse is inserted between first and second charging periods ST1 and ST2. In the first and second charging periods ST1 and ST2, the switching transistor M1 (see FIG. 2) of each pixel PX is turned on. Thus, a data signal is applied to the first node N1 (see FIG. 2). In order to be driven by a line reversal method, the common voltage Vcom, of the current embodiment, has different levels in the first and second charging periods ST1 and ST2.

In the embodiment illustrated in FIG. 6, the common voltage Vcom has a high level during the first charging period ST1. The common voltage Vcom has a low level during the second charging period ST2. A first intermediate period EQ1 is between the first charging period ST1 and the second charging period ST2. A second intermediate period EQ2 is between the second charging period ST2 and a next first charging period ST1. In the first intermediate period EQ1, the common voltage Vcom has a predetermined voltage level between voltage levels of the first and second charging periods ST1 and ST2. The common voltage Vcom has at least one pulse. In the second intermediate period EQ2, the common voltage Vcom has a predetermined voltage level lower than a level of the common voltage Vcom during the second charging period ST2. The common voltage Vcom has at least one pulse.

The first intermediate period EQ1 includes a first period T1, a second period T2, and a third period T3. During the first period T1, the common voltage Vcom has a predetermined level between voltage levels of the first and second charging periods ST1 and ST2. During the second period T2, the common voltage Vcom has a voltage level higher than a voltage level of the first period T1. The common voltage Vcom is equal to or lower than the voltage level of the first charging period ST1. During the third period T3, the common voltage Vcom has a predetermined level between the voltage levels of the first and second charging periods ST1 and ST2. The voltage level of the common voltage Vcom, during the third period T3, may be equal to that of the common voltage Vcom during the first period T1.

The second intermediate period EQ2 includes a fourth period T4, a fifth period T5, and a sixth period T6. During the fourth period T4, the common voltage Vcom has a voltage level lower than that of the second charging period ST2. During the fifth period T5, the common voltage Vcom has a voltage level higher than the voltage level of the common voltage Vcom during the fourth period T4 and a voltage level of the common voltage Vcom during the sixth period T6. The common voltage Vcom is equal to or lower than a voltage level of the first charging period ST1. During the sixth period T6, the common voltage Vcom has a voltage level that is lower than the voltage levels of the common voltage Vcom during the fifth period T5 and the first charging period ST1. The voltage level of the common voltage Vcom, during the sixth period T6, may be equal to that of the common voltage Vcom during the fourth period T4.

The data signal output from the data driving unit 130 (see FIG. 1) has a valid level during the first charging period ST1 and the second charging period ST2. The data signal may have a predetermined level lower than that of the common voltage Vcom during the first charging period ST1. The data signal may have a predetermined level higher than that of the common voltage Vcom during the second charging period ST2.

Figure 7:
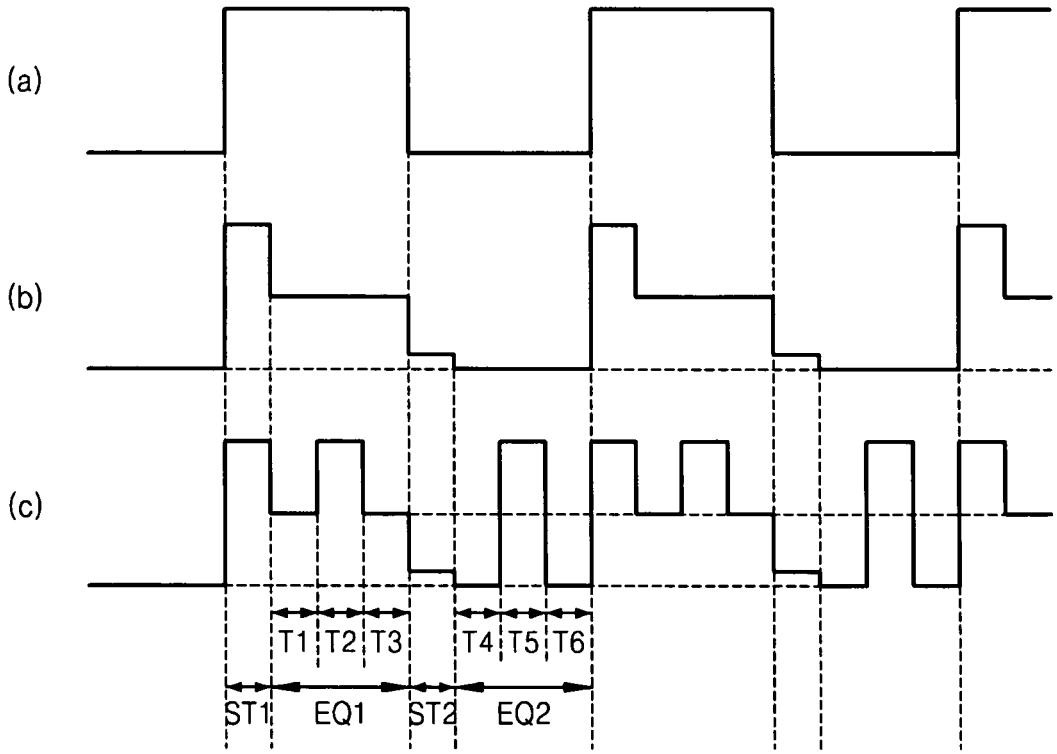
FIGS. 7 (*a*)-(*c*) are diagrams illustrating waveforms of common voltages according to comparative examples and an embodiment.

FIG. 7 is a diagram illustrating waveforms of common voltages Vcom according to examples and a present embodiment. FIG. 7 (*a*) illustrates a first comparative example. FIG. 7 (*b*) illustrates a second comparative example. FIG. 7(*c*) illustrates a present embodiment. FIGS. 7 (*a*) through 7 (*c*) illustrate a model having a frame frequency of 60 Hz and a QVGA resolution.

The first comparative example, illustrated in FIG. 7 (*a*), has the simplest waveform. In a row having a positive polarity, the common voltage Vcom maintains a high level in periods other than a charging period ST1. Thus, a great amount of power is consumed. The frequency of the common voltage Vcom is within the audible noise range. Thus, audible noise is generated.

In the second comparative example illustrated in FIG. 7 (*b*), in which a first intermediate period EQ1 and a second intermediate period EQ2 are disposed between the first charging period ST1 and the second charging period ST2, the common voltage Vcom has a voltage level lower than that of the first charging period ST1 during the first intermediate period EQ1. The common voltage Vcom has a voltage level lower than that of the second charging period ST2 during the second intermediate period EQ2. Thus, power consumed during the first intermediate period EQ1 and the second intermediate period EQ2 may be reduced. Even in the second comparative example illustrated in FIG. 7 (*b*), the common voltage Vcom has an audible frequency with a great intensity. Thus, audible noise is still generated.

In the present embodiment, illustrated in FIG. 7 (*c*), the common voltage Vcom has three peaks ST1, T2, and T5. One period includes a first charging period ST1, a first intermediate period EQ1, a second charging period ST2, and a second intermediate period EQ2. Thus, a frequency of the common voltage Vcom is increased by three times. The frequency of the common voltage Vcom is dispersed, reducing components of an audible frequency, and reducing audible noise.

A human's audible frequency range is from about 16 Hz to about 20 kHz. When present embodiments are applied, a frequency of the common voltage Vcom is out of the audible frequency range. For example, a liquid crystal display apparatus is driven with a portrait QVGA normal 60 Hz. Each pixel includes three sub-pixels. If present embodiments are not applied, each pixel includes 320*3 gate lines and 240 data lines, and the frequency of the common voltage Vcom is within the audible frequency range. However, when present embodiments are applied, the frequency of the common voltage Vcom is more than 30 kHz. Thus, the frequency of the common voltage Vcom is out of the audible frequency range.

Alternatively, a liquid crystal display apparatus is driven with a landscape QVGA normal 60 Hz. Each pixel includes three sub-pixels. If present embodiments are not applied, each pixel include includes 240*3 gate lines and 320 data lines, and the frequency of the common voltage Vcom is 7 kHz. 7 kHz is within the audible frequency range. However, when present embodiments are applied, the frequency of the common voltage Vcom is more than 21 kHz. Thus, the frequency of the common voltage Vcom is out of the audible frequency range.

Present embodiments are be used when a common voltage has Vcom less than 20,000 periods within one second. In other words, first and second charging periods ST1 and ST2 have less than 40,000 periods within one second.

Figure 8:
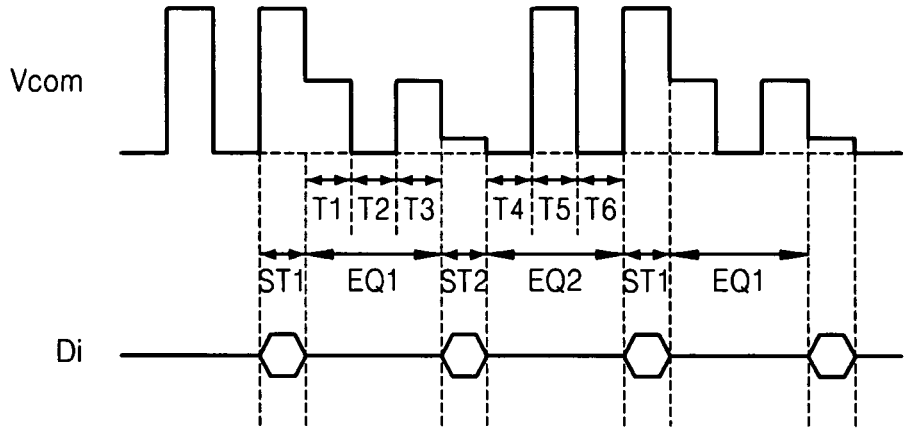
FIG. 8 is a diagram illustrating a waveform of a common voltage, according to another embodiment.

FIG. 8 is a diagram illustrating a waveform of a common voltage Vcom, according to another embodiment.

According to another embodiment, when the common voltage Vcom drives the liquid crystal display apparatus 100 by a line reversal method, a first charging period ST1 has a high level, a second charging period ST2 has a low level, a first intermediate period EQ1 includes a falling pulse, and a second intermediate period EQ2 includes a rising pulse.

The first intermediate period EQ1 includes a first period T1, a second period T2, and a third period T3. During the first period T1, the common voltage Vcom has a predetermined level, between voltage levels of the first and second charging periods ST1 and ST2. During the second period T2, the common voltage Vcom has a voltage level lower than the first period T1 and the third period T3. During the third period T3, the common voltage Vcom has a predetermined level between the voltage levels of the first and second charging periods ST1 and ST2. During the third period T3, the voltage level of the common voltage Vcom may be equal to that of the common voltage Vcom during the first period T1.

The second intermediate period EQ2 includes a fourth period T4, a fifth period T5, and a sixth period T6. During the fourth period T4, the common voltage Vcom has a voltage level lower than that of the second charging period ST2. During the fifth period T5, the common voltage Vcom has a voltage level that is higher than the voltage level of the common voltage Vcom during the fourth period T4 and a voltage level of the common voltage Vcom during the sixth period T6. The common voltage Vcom during the fifth period T5 is equal to or lower than a voltage level of the first charging period ST1. During the sixth period T6, the common voltage Vcom has a voltage level lower than those of the common voltage Vcom during the fifth period T5 and the first charging period ST1. The voltage level of the common voltage Vcom during the sixth period T6 may be equal to that of the common voltage Vcom during the fourth period T4.

In another embodiment, the common voltage Vcom may have two peaks ST1 and T5 during one period. One period may include the first charging period ST1, the first intermediate period EQ1, the second charging period ST2, and the second intermediate period EQ2. Accordingly, a frequency of the common voltage Vcom may be increased twice. The frequency of the common voltage Vcom may be dispersed, reducing components of audible noise.

In another embodiment, a falling peak of the second period T2 is included. Thus, audible noise may be offset by the falling peak.

According to the embodiments, in a liquid crystal display apparatus employing a polarity reversal method, audible noise may be removed without increasing a frame frequency and reducing a charging time of a storage capacitor. Accordingly, according to the embodiments, audible noise may be removed without deterioration of a picture quality of the liquid crystal display apparatus.

In the conventional art, when voltages having the same polarity are continuously applied, a liquid crystal layer deteriorates. In order to prevent the liquid crystal layer from deteriorating, a polarity reversal method has been used. The polarity reversal method reverses a polarity for a predetermined period (e.g., one frame). Examples of the polarity reversal method are a line reversal method and a dot reversal method.

Present embodiments may provide a liquid crystal display apparatus that employs a polarity reversal method. Present embodiments may not increase a frame frequency or reduce a charging time of a storage capacitor. In addition, present embodiments may remove audible noise.

Exemplary embodiments of the inventive concept have been disclosed herein, and although specific terms are employed, they are used and are to be interpreted in a generic and descriptive sense only and not for purpose of limitation. Accordingly, it will be understood by those of ordinary skill in the art that various changes in form and details may be made without departing from the spirit and scope of the inventive concept as set forth in the following claims.

What is claimed is:

1. A method of driving a liquid crystal display apparatus, including a line reversal method and a plurality of pixels, the method comprising:

applying a data signal and a common voltage having a first voltage level to selected pixels of a first line in a first charging period, so that selected pixels of the first line have a first polarity;

electrically blocking pixel electrodes of the plurality of pixels and data lines for delivering the data signal in a first intermediate period, wherein the common voltage includes at least one pulse;

applying the data signal and the common voltage having a second voltage level lower than the first level to selected pixels of a second line in a second charging period, so that selected pixels of the second line have a second polarity, opposite the first polarity; and electrically blocking the pixel electrodes of the plurality of pixels and the data lines in a second intermediate period, wherein the common voltage includes at least one pulse, wherein one period includes the first charging period, the first intermediate period, the second charging period, and the second intermediate period in order, and wherein, in the first intermediate period, the common voltage has a third voltage level between the first voltage level and the second voltage level, and includes at least one pulse having a rising edge and a falling edge, and wherein, in the second intermediate period, the common voltage has a fourth voltage level lower than the second voltage level, and includes at least one pulse having a rising edge and a falling edge.

2. The method as claimed in claim 1, wherein:

the first intermediate period has at least one rising pulse having a rising edge from the third voltage level to a fifth voltage level and a falling edge from the fifth voltage level to the voltage third level, and the second intermediate period has at least one rising pulse having a rising edge from the fourth voltage level to the fifth voltage level and a falling edge from the fifth voltage level to the fourth voltage level.

3. The method as claimed in claim 2, wherein:

the first intermediate period comprises:

a first period in which the common voltage has the third voltage level between voltage levels of the first and second charging periods;

a second period in which the common voltage has the fifth voltage level that is higher than that in the first period and that is equal to or lower than that of the first charging period; and a third period in which the common voltage has the third voltage level between the voltage levels of the first and second charging periods.

4. The method as claimed in claim 2, wherein:

the second intermediate period comprises:

a fourth period in which the common voltage has the fourth voltage level lower than that of the second charging period;

a fifth period in which the common voltage has the fifth voltage level that is higher than that of the fourth period and that is equal to or lower than that of the first charging period; and a sixth period in which the common voltage has the third voltage level that is lower than those of the fifth period and the first charging period.

5. The method as claimed in claim 1, wherein: the first intermediate period has at least one falling pulse having a falling edge from the third voltage level to a fourth voltage level and a rising edge from the fourth voltage level to the third voltage level, and the second intermediate period has at least one rising pulse having a rising edge from the fourth voltage level to a fifth voltage level and a falling edge from the fifth voltage level to the fourth voltage level.

6. The method as claimed in claim 5, wherein:

the first intermediate period comprises:

a first period in which the common voltage has the third voltage level between the voltage levels of the first and second charging periods;

a second period in which the common voltage has the fourth voltage level lower than that of the first period; and a third period in which the common voltage has the third voltage higher than that of the second period.

7. The method as claimed in claim 5, wherein:

the second intermediate period comprises:

a fourth period in which the common voltage has the fourth voltage level lower than that of the second charging period;

a fifth period in which the common voltage has the fifth voltage level that is higher than that of the fourth period and that is equal to or lower than that of the first charging period; and a sixth period in which the common voltage has the fourth voltage level that is lower than those of the fifth period and the first charging period.

8. The method as claimed in claim 1, wherein: the common voltage has less than 20,000 periods within one second.

9. The method as claimed in claim 1, wherein: the common voltage is applied through a common voltage layer, electrically connected to the plurality of pixels in common.

10. A liquid crystal display apparatus, comprising:

a plurality of pixels;

a common voltage electrode that is connected to the plurality of pixels in common;

a gate driver to output a gate signal via gate lines to each of the plurality of pixels;

a data driver to generate a data signal corresponding to an input image and to output the data signal to each of the plurality of pixels via data lines; and a common voltage driver to generate a common voltage and to apply the common voltage to the plurality of pixels through the common voltage electrode, wherein applying the common voltage includes:

a first charging period in which the data signal and the common voltage having a first voltage level are applied to selected pixels of a first line so that the selected pixels of the first line selected by the gate signal have a first polarity;

a first intermediate period in which data lines for delivering the data signal and pixel electrodes of the plurality of pixels are electrically blocked, wherein the common voltage includes at least one pulse;

a second charging period in which the data signal and the common voltage having a second voltage level lower than the first voltage level are applied to selected pixels of a second line so that selected pixels of the second line selected by the gate signal have a second polarity, opposite to the first polarity; and a second intermediate period in which the pixel electrodes of the plurality of pixels and the data lines are electrically blocked, wherein the common voltage includes at least one pulse, wherein one period includes the first charging period, the first intermediate period, the second charging period, and the second intermediate period in order, and wherein, in the first intermediate period, the common voltage has a third voltage level between the first voltage level and the second voltage level, and includes at least one pulse having a rising edge and a falling edge, and wherein, in the second intermediate period, the common voltage has a fourth voltage level lower than the second voltage level, and includes at least one pulse having a rising edge and a falling edge.

11. The liquid crystal display apparatus as claimed in claim 10, wherein:

the first intermediate period has at least one rising pulse having a rising edge from the third voltage level to a fifth voltage level and a falling edge from the fifth voltage level to the voltage third level, and the second intermediate period has at least one rising pulse having a rising edge from the fourth voltage level to the fifth voltage level and a falling edge from the fifth voltage level to the fourth voltage level.

12. The liquid crystal display apparatus as claimed in claim 11, wherein:

the first intermediate period comprises:

a first period in which the common voltage has the third voltage level between voltage levels of the first and second charging periods;

a second period in which the common voltage has the fifth voltage level that is higher than that in the first period and that is equal to or lower than that of the first charging period; and a third period in which the common voltage has the third voltage level between the voltage levels of the first and second charging periods.

13. The liquid crystal display apparatus as claimed in claim 11, wherein:

the second intermediate period comprises:

a fourth period in which the common voltage has the fourth voltage level lower than that of the second charging period;

a fifth period in which the common voltage has the fifth voltage level that is higher than that of the fourth period and that is equal to or lower than that of the first charging period; and a sixth period in which the common voltage has the fourth voltage level that is lower than those of the fifth period and the first charging period.

14. The liquid crystal display apparatus as claimed in claim 10, wherein:

the first intermediate period has at least one falling pulse having a falling edge from the third level to a fourth level and a rising edge from the fourth level to the third level, and the second intermediate period has at least one rising pulse having a rising edge from the fourth voltage level to a fifth voltage level and a falling edge from the fifth voltage level to the fourth voltage level.

15. The liquid crystal display apparatus as claimed in claim 14, wherein:

the first intermediate period comprises:

a first period in which the common voltage has the third voltage level between the voltage levels of the first and second charging periods;

a second period in which the common voltage has the fourth voltage level lower than that of the first period; and a third period in which the common voltage has the third voltage higher than that of the second period.

16. The liquid crystal display apparatus as claimed in claim 14, wherein:

a voltage level of the common voltage is higher in the first charging period than in the second charging period, and the second intermediate period comprises:

a fourth period in which the common voltage has the fourth voltage level lower than that of the second charging period;

a fifth period in which the common voltage has the fifth voltage level that is higher than that of the fourth period and that is equal to or lower than that of the first charging period; and a sixth period in which the common voltage has the fourth voltage level that is lower than those of the fifth period and the first charging period.

17. The liquid crystal display apparatus as claimed in claim 10, wherein: the common voltage has less than 20,000 periods within one second.

18. The liquid crystal display apparatus as claimed in claim 10, wherein: the common voltage electrode is formed to have a plate structure connected to the plurality of pixels in common.

19. The liquid crystal display apparatus as claimed in claim 10, wherein:

each pixel of the plurality of pixels comprises:

a first switching transistor having a gate electrode connected to the gate line, a first electrode connected to the data line, and a second electrode connected to a first node;

a liquid crystal layer interposed between a pixel electrode, which is connected to the first node, and the common voltage electrode; and a storage capacitor connected between the first node and the common voltage electrode.

20. A method of controlling a liquid crystal display, the method comprising:

applying a first voltage to a common electrode in a first charging period;

applying a second voltage in a first period, a third voltage in a second period, and the second voltage in a third period to the common electrode in a first intermediate period;

applying a fourth voltage to the common electrode in a second charging period; and applying a fifth voltage in a fourth period, a sixth voltage in a fifth period, and the fifth voltage in a third period to the common electrode in a second intermediate period, wherein the liquid crystal display is driven by a line reversal method and wherein:

the fifth voltage is less than the fourth voltage, the first and fourth voltages have different magnitudes, the second voltage is between the first and fourth voltages, and the first intermediate period is between the first and second charging periods and the second intermediate period is after the second charging period.

* * * * *